US007155967B2

(12) United States Patent
Rylander et al.

(10) Patent No.: US 7,155,967 B2
(45) Date of Patent: Jan. 2, 2007

(54) FORMATION TESTING APPARATUS AND METHOD

(75) Inventors: Erik Rylander, Harvey, LA (US); Robert Jeffries, New Orleans, LA (US); Glenn Houston, New Orleans, LA (US); Sammy S. Haddad, Mandeville, LA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/191,709

(22) Filed: Jul. 9, 2002

(65) Prior Publication Data

US 2004/0007058 A1 Jan. 15, 2004

(51) Int. Cl.
*E21B 47/00* (2006.01)

(52) U.S. Cl. ..... 73/152.39; 73/64.56; 73/152.23; 73/152.24; 73/152.25; 73/863.23; 166/250.01

(58) Field of Classification Search ..... 73/152.39, 73/64.56, 152.23, 152.24, 152.25, 863.21, 73/863.23, 865.5, 31.07; 166/100, 105.1, 166/250.01, 254.2, 265, 64; 175/63, 234, 175/4, 78

See application file for complete search history.

(56) References Cited

U.S. PATENT DOCUMENTS 2,020,856 A * 11/1935 Schlumberger ..... 175/4
2,176,375 A * 10/1939 McClinton ..... 175/78
2,965,176 A * 12/1960 Brieger et al. ..... 166/63
3,254,531 A * 6/1966 Briggs, Jr. ..... 73/152.24
3,352,361 A * 11/1967 Urbanosky ..... 166/100
3,434,540 A * 3/1969 Stein ..... 166/250.01
3,816,894 A * 6/1974 Howard et al. ..... 29/896.62
3,864,970 A * 2/1975 Bell ..... 73/152.25
3,934,468 A 1/1976 Brieger
4,493,383 A * 1/1985 Williams et al. ..... 175/234
4,711,299 A * 12/1987 Caldwell et al. ..... 166/105.1
4,830,107 A * 5/1989 Rumbaugh ..... 166/250.07
4,860,581 A 8/1989 Zimmerman et al.
4,924,940 A * 5/1990 Burroughs et al. ..... 166/105.1
5,042,297 A * 8/1991 Lessi ..... 73/152.31
5,295,537 A * 3/1994 Trainer ..... 166/105.1
5,443,119 A * 8/1995 Chambers et al. ..... 166/254.2
RE35,454 E * 2/1997 Cobb ..... 166/265
5,925,242 A * 7/1999 McGhee ..... 210/164
6,561,046 B1 * 5/2003 Taylor et al. ..... 73/863.23

* cited by examiner

*Primary Examiner*—Daniel S. Larkin
(74) *Attorney, Agent, or Firm*—Matthias Abrell; Kevin P. McEhaney; William Batzer

(57) ABSTRACT

A method and apparatus for testing formations surrounding an earth borehole. The method includes the following steps: providing a tool movable through the borehole; providing a flow line in the tool; establishing fluid communication between the formations and the flow line of the tool; and providing a sand trap in communication with the flow line of the tool for trapping sand flowing with fluid from the formations.

22 Claims, 5 Drawing Sheets

FORMATION TESTING APPARATUS AND METHOD

FIELD OF THE INVENTION

This invention relates to the field of testing formations surrounding an earth borehole with a formation testing tool and, more particularly, to improvements in formation sampling, pressure measurement, and other measurements.

BACKGROUND OF THE INVENTION

Existing well logging devices can provide useful information about hydraulic properties of formations, such as pressures and fluid flow rates, and can obtain formation fluid samples for uphole analysis. Reference can be made, for example, to U.S. Pat. Nos. 3,934,468 and 4,860,581. In a logging device of this general type, a setting arm or setting pistons can be used to controllably urge the body of the logging device against a side of the borehole at a selected depth. The side of the device that is urged against the borehole wall includes a packer which surrounds a probe. As the setting arm extends, the probe is inserted into the formation, and the packer then sets the probe in position and forms a seal around the probe, whereupon formation pressure can be measured and fluids can be withdrawn from the formation.

In certain prior art application of formation testing, a gravel pack is provided at the place where the formation is perforated, to help maintain the integrity of the perforation and to prevent sand from clogging the opening. This gravel pack is generally not made too fine, as it would then tend to clog easily. From experience, it has been recognized that even when a gravel pack is employed at the probe, some sand tends to flow with fluid being sampled. This sand can cause problems with down hole pumps either plugging or by compromising the seals in the pump. As a result of the sand entering the pump, formation tester logging jobs may have to be terminated prematurely or multiple trips in the well may be necessary to acquire all the desired fluid samples. In addition, sampling during cased hole formation tester jobs can be compromised due to metal shavings from the casing entering the formation tester's down hole pump.

It is among the objects of the present invention to address this problem of prior art formation testing tools.

It is also among the objects of the present invention to improve formation testing methods and equipment to obtain enhanced information about the nature of formations being tested, including characteristics of solid components of the formations being tested.

SUMMARY OF THE INVENTION

In accordance with a form of the invention, there is set forth an apparatus for testing formations surrounding an earth borehole. A tool, movable through the borehole, is provided, the tool having a flow line running therethrough. Means, in the tool, are provided for establishing fluid communication between the formations and the flow line in the tool. A sand trap is provided in the tool for trapping sand in the fluid from the formations travelling in the flow line. In an embodiment of this form of the invention, the sand trap comprises a receptacle containing a screen that is operative to cause precipitation of sand in the formation fluid and also to filter sand from the formation fluid. In this embodiment, the tool includes a pump in the flow line, and the sand trap is located so that sand-containing fluid from the formations reaches the sand trap before reaching the pump.

In accordance with another form of the invention a method is set forth for testing formations surrounding an earth borehole, including the following steps: providing a tool movable through the borehole; providing a flow line in the tool; establishing fluid communication between the formations and the flow line of the tool; and providing a sand trap in communication with the flow line of the tool for trapping sand flowing with fluid from the formations. An embodiment of this form of the invention further comprises bringing the tool to the earth's surface, collecting the sand from the sand trap, and analyzing the sand to determine properties thereof.

In accordance with a feature of the present invention, the obtained sand is a sample of recovered reservoir rock at the point or points of measurement and sampling in the borehole. Among the advantages of having such samples are the following: knowing of sand texture (grain size, shape and sorting) can provide key indicators of depositional environment; the nature of the sand sample can provide information on types and degree of cementation, as well as porosity and permeability indications, and lithologic and facies verification; and indication of clay minerals in the sampled zone can help in deposition environment models and completion and production design. The foregoing can be especially useful in thin beds where formation properties change drastically within very short vertical distances. Evidence of good quality sands within the interbeds would reinforce reservoir characterization. Also, sand grain size and distribution can provide important information in sand control completion design, and gravel pack mesh size and gravel pack screen design can be significantly improved if one has a sand sample.

In accordance with a further feature of the invention, a useful pressure measurement can be taken when sand starts to flow, without fouling of the tool. The pressure inside the tool at which formation sand grains are mobilized represents a measurement of the formation failure pressure or differential pressure (difference between formation pressure and tool pressure). This measurement represents the condition of differential pressure at which the well will start producing sand along with formation fluids during the production phase. This value of differential pressure at which the formation will fail can be used to design well completion and production strategies.

Further features and advantages of the invention will become more readily apparent from the following detailed description when taken in conjunction with the accompanying drawings.

DETAILED DESCRIPTION

Figure 1:
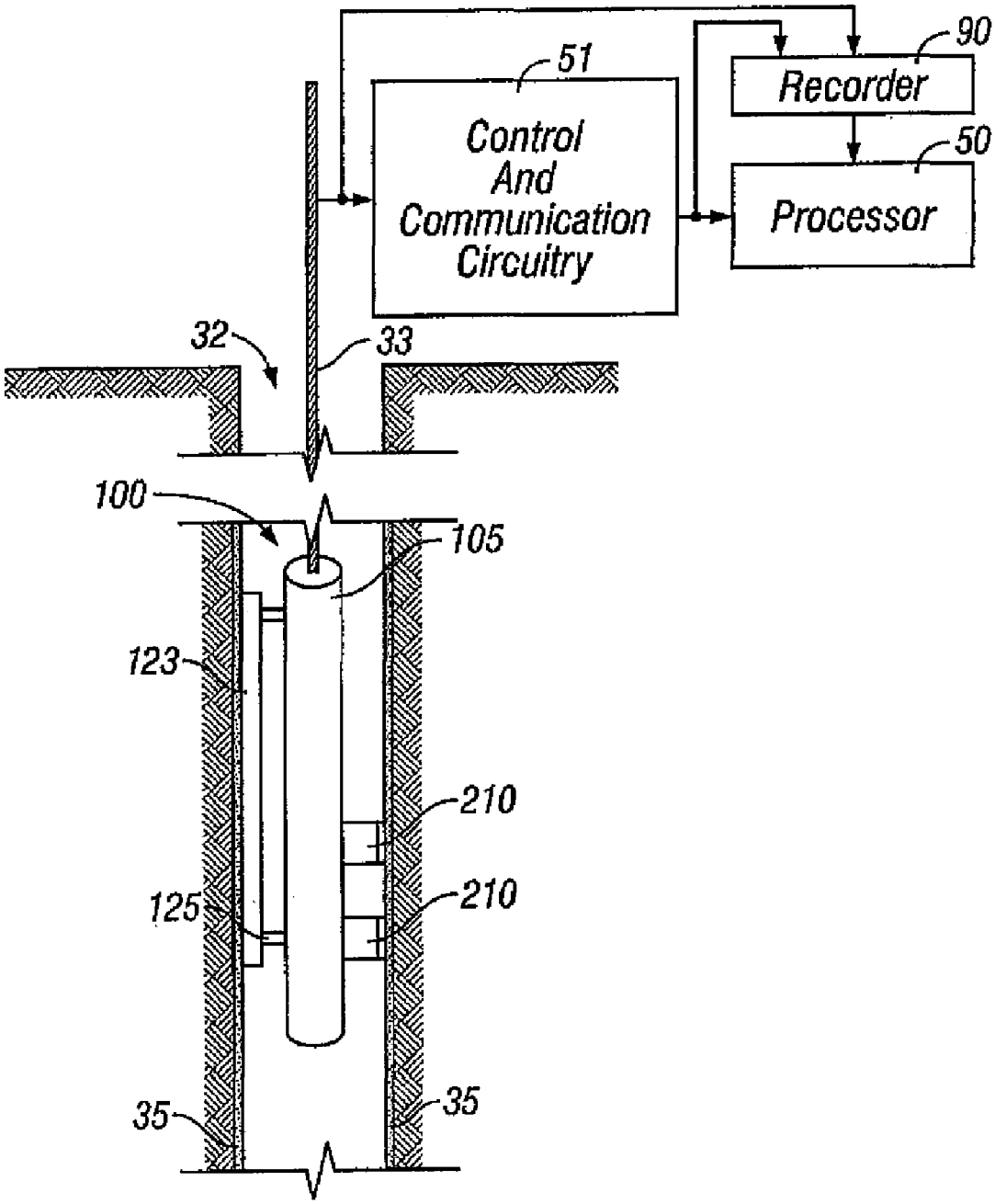
FIG. 1 is a diagram, partially in block form, of a logging device in which embodiments of the invention can be employed.

Referring to FIG. 1 there is shown a representative embodiment of a formation tester apparatus for investigating subsurface formations 31 traversed by a borehole 32, which can be used in practicing embodiments of the invention. The borehole 32 is typically filled with drilling fluid or mud which contains finely divided solids in suspension. A mudcake on the borehole wall is represented at 35. However, the invention can also have application to other situations, for example, operation in a cased borehole. The investigating apparatus or logging device 100 is suspended in the borehole 32 on an armored multiconductor cable 33, the length of which substantially determines the depth of the device 100. Known depth gauge apparatus (not shown) is provided to measure cable displacement over a sheave wheel (not shown) and thus the depth of logging device 100 in the borehole 32. The cable length is controlled by suitable means at the surface such as a drum and winch mechanism (not shown). Circuitry 51, shown at the surface although portions thereof may typically be downhole, represents control and communication circuitry for the logging apparatus. Also shown at the surface are processor 50 and recorder 90. These may all generally be of known type.

The logging device or tool 100 has an elongated body 105 which encloses the downhole portion of the device, controls, chambers, measurement means, etc. One or more arms 123 can be mounted on pistons 125 which extend, e.g. under control from the surface, to set the tool. The logging device includes one or more probe modules each of which includes a probe assembly 210 which is movable with a probe actuator (not separately shown) and includes a probe (not separately shown) that is outwardly displaced into contact with the borehole wall, piercing the mudcake and communicating with the formations. The equipment and methods for taking pressure measurements and doing sampling are well known in the art, and the logging device 100 is provided with these known capabilities. Reference can be made, for example, to U.S. Pat. Nos. 3,934,468 and 4,860,581, which describe early versions of devices of this general type.

Modern commercially available services utilizing, for example, a modular formation dynamics tester ("MDT"—trademark of Schlumberger), can provide a variety of measurements and samples, as the tool is modularized and can be configured in a number of ways. Examples of some of the modules employed in this type of tool, are as follows: An electric power module is generally provided. It does not have a flowline or hydraulic bus, and will typically be the first (top) module in the string. A hydraulic power module provides hydraulic power to all modules that may require same, and such power can be propagated via a hydraulic bus. Probe modules, which can be single or plural probes, includes pistons for causing engagement of probe(s) for fluid communication with the formations. Sample modules contain sample chambers for collecting samples of formation fluids, and can be directly connected with sampling points or connected via a flowline. A pumpout module can be used for purging unwanted fluids. An analyzer module uses optical analysis to identify characteristics of fluids. A packer module includes inflatable packer elements which can seal the borehole circumference over the length of the packer elements.

Using the foregoing and other types of modules, the tool can be configured to perform various types of functions. Examples are permeability measurements, pressure gradient testing, PVT sampling, and interval testing. The present invention has application to all of these.

Figure 2:
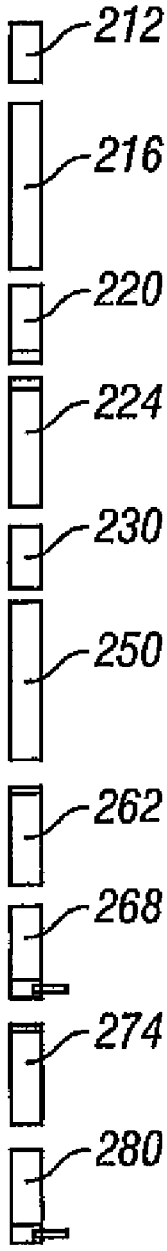
FIG. 2 is a block diagram of an example of a modular tool in which embodiments of the invention cam be employed.

Referring to FIG. 2, there is shown an example of a formation tester tool string in which embodiments of the invention can be employed. It is emphasized, that this particular configuration is an example, and the invention has application to many other tool configurations, modular or otherwise. In FIG. 2, 212 represents an electronics module that provides electrical power and control. The module 216 is of the type that contains an exit port (for returning formation fluids to the borehole) and a plurality of bottles for collecting samples. The module 220 is of the type that contains a single large volume bottle or receptacle for sampling. The module 224 is a pump-out module, and the module 230 is a fluid analyzer module, for example of the optical type noted briefly above. The module 250, in the present example, is the type of module that ordinarily would contain several (e.g. six) sample chambers or bottles, each capable of holding a sample of, for example, 450 cc. In accordance with an embodiment of the invention, one or a plurality of the sample chambers are replaced with respective sand traps which can be, for example, of the type described hereinbelow. The blocks 262 and 274 are hydraulic power and control modules, and the modules 268 and 280 are pad/probe modules.

As an example of a job that includes sampling, the tool is set, a pretest is taken, the pump is turned on and the formation fluid goes through the flow line of all the modules until reaching the exit port at which, after the contamination level reaches an acceptable level (as monitored by the fluid analyzer module), the exit port is shut off and the sample is routed into a chamber (for example, one of the bottles in module 250 and/or the large volume sample chamber of module 220). In order to capture sand in the formation fluid before it reaches the pump-out module, it is desirable to put the sand trap below the pump-out module. In an embodiment hereof, sand-containing formation fluid is routed through the sand trap in the module 250. The formation fluid then continues through the water line of the module, back into the flow line, through the pump-out module, and out the exit port to the well bore. The chambers above the pump-out, in module 216, can be filled in the same fashion as they would be conventionally.

Figure 3:
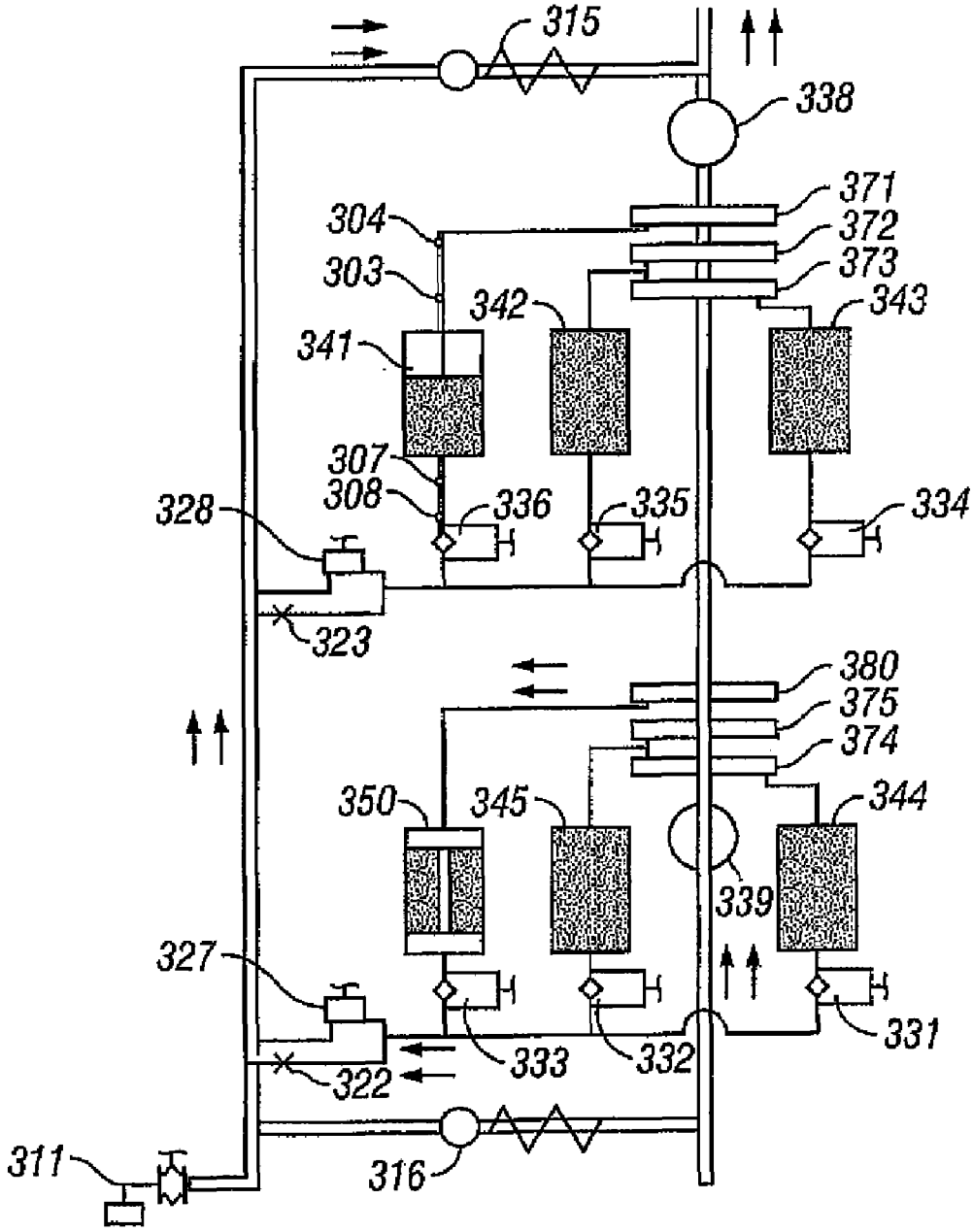
FIG. 3 is a block diagram of a portion of a system employing an embodiment of the invention.
Figure 4:
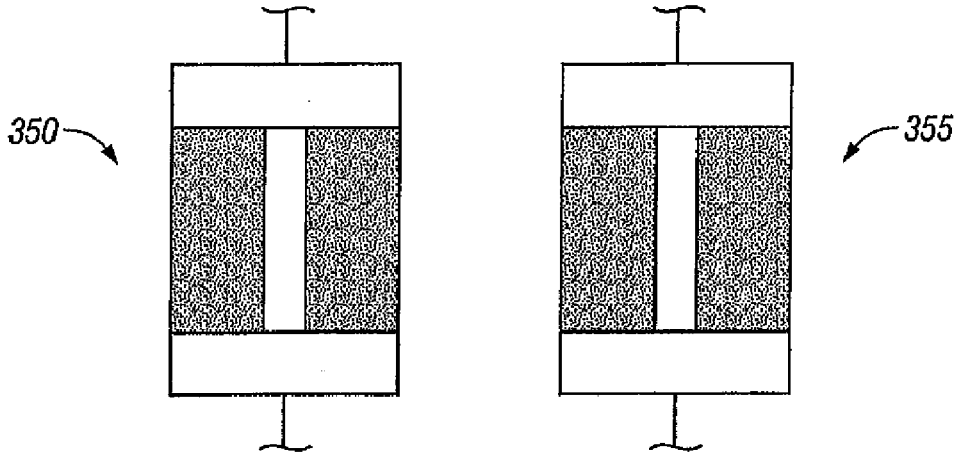
FIG. 4 is a diagram showing a portion of the FIG. 3 system employing a plurality of sand trap assemblies in accordance with an embodiment of the invention.

FIG. 3 shows an embodiment of the module 250 of FIG. 2, wherein a sand trap is provided in accordance with an embodiment of the invention. In FIG. 3, the reference numerals 341, 342, 343, 344, and 345 refer to sample bottles. A sand trap assembly 350, in accordance with an embodiment of the invention, is substituted for one of the original six bottles. It will be understood that more than one sand trap assembly can be employed, consistent with the principles hereof. For example, another sandtrap assembly (355) can be substituted for sample bottle 345, as shown in FIG. 4.

Referring again to FIG. 3, reference numerals 303 and 304 represent bleed plugs, and reference numerals 307 and 308 represent drain valves. Reference numeral 311 represents a charge valve, and reference numerals 315 and 316 represent pressure relief valves. The reference numerals 322 and 323 represent flow restrictors, and the reference, numerals 327 and 328 represent bypasses. Also, the reference numerals 331, 332, 333, 334, 335 and 336 represent check valves with respective bypasses. The reference numeral 338 represents an upper throttle/seal valve, and the reference numeral 339 represents a lower throttle/seal valve. The reference numerals 371, 372, 373, 374, 375 and 380, represent control valves for the sample bottles 341 through 345, and sand trap assembly 350, respectively. In the present embodiment, these are single-shot control valves, two per bottle or sand trap assembly, as the case may be. In the FIG. 3 diagram, the double arrows show the flow path.

Figure 5:
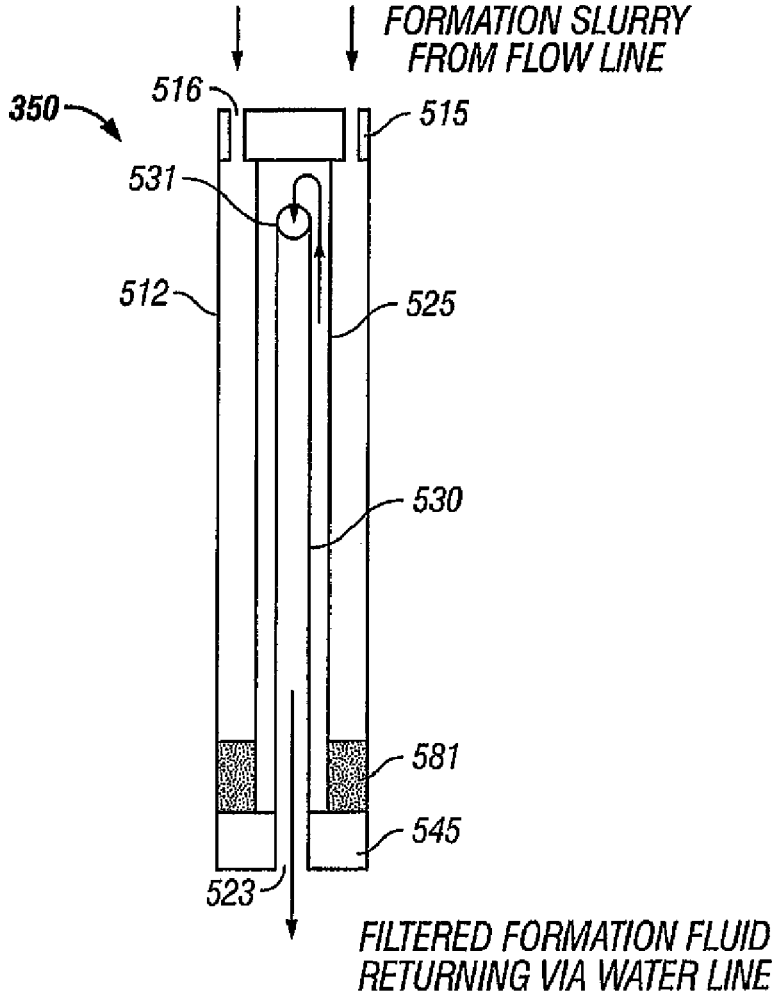
FIG. 5 is a cross-sectional diagram of a sand trap assembly in accordance with an embodiment of the invention.

Referring to FIG. 5, there is shown a sand trap assembly 350 in accordance with an embodiment of the invention. A cylindrical tube or receptacle housing 512 has a top endcap 515 with apertures 516. Inside the housing 512 is a tubular screen 525, and inside the screen is a stand pipe 530, one end of which (531), near the top endcap, is opened, and the other end of which fits into a central aperture in a bottom endcap 545.

In operation, the formation fluid (typically a slurry of the fluid with some sand) from the flow line enters the sand trap assembly by flowing through apertures 516 of the top endcap and around the screen 525. At this time, the change in volume reduces the flow rate causing sand to precipitate to the bottom of the receptacle (e.g. at 581). The formation fluid passes through the screen providing further filtering. Then, the formation fluid, absent the sand, enters the top (531) of the stand pipe 530 and flows out through the bottom of the bottle into the water line, which returns the formation fluid to the main flow line.

The upper seal valve 338 may be opened and sample chambers above the pump-out may be filled. By opening the upper seal valve, any pressure drop occurring across the sand trap may be avoided (unlike a gravel packed probe where sample quality is compromised due to a large pressure drop across the gravel pack). It is not necessary to close the inlet to the sand trap before filling the sample chambers above the pump-out. Sand from the sand trap will not flow back out the top of the sand trap because the upper pressure relief valve (315) will not allow fluid to displace what is already inside the receptacle. The remaining bottles of the multisampler below the pump out may be filled with formation fluid by closing the upper seal valve, closing the inlet to the sand trap, and opening the valve to the desired sample bottle. The sample bottle may then be filled by pulling down the sample piston from the back side with the pump-out module.

Figure 6:
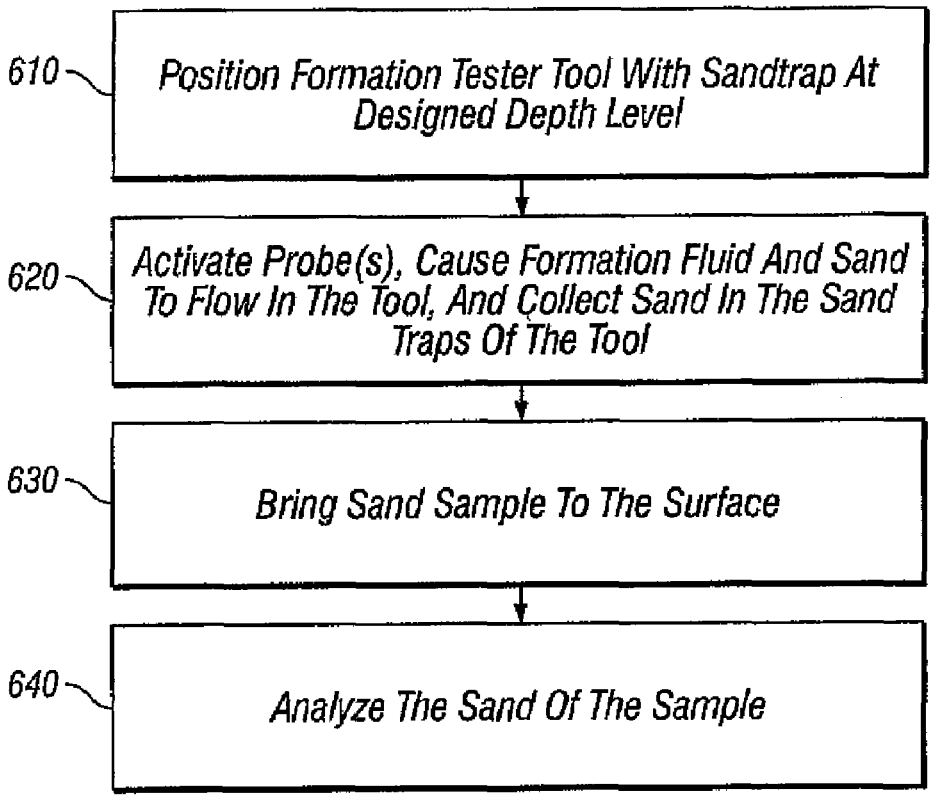
FIG. 6 is a diagram setting forth a sequence of steps in accordance with an embodiment of the invention.

Referring to FIG. 6, there is shown a diagram of steps of a method, in accordance with an embodiment of the invention, for obtaining samples of formation matrix, in the form of sand, bringing it to the surface, and then analyzing the sand to obtain, for example, particle size distribution and other information. The block 610 represents positioning of a formation tester tool having a sand trap in accordance with the invention, at a desired depth level in the borehole. The block 620 represents activation of probe(s), in the tool, the causing of formation fluid and sand to flow in the tool, and the collecting of sand in the sand trap of the tool, as described herein. The block 630 represents bringing the sand sample to the surface. The block 640 represents the analyzing of the sand sample. This can include any known type of analysis to determine properties of the sand, for example, particle size distribution.

In accordance with a further feature of the invention, a useful pressure measurement can be taken when sand starts to flow, without fouling of the tool. The pressure inside the tool at which formation sand grains are mobilized represents a measurement of the formation failure pressure or differential pressure (difference between formation pressure and tool pressure). This measurement represents the condition of differential pressure at which the well will start producing sand along with formation fluids during the production phase. This value of differential pressure at which the formation will fail can be used to design well completion and production strategies.

Figure 7:
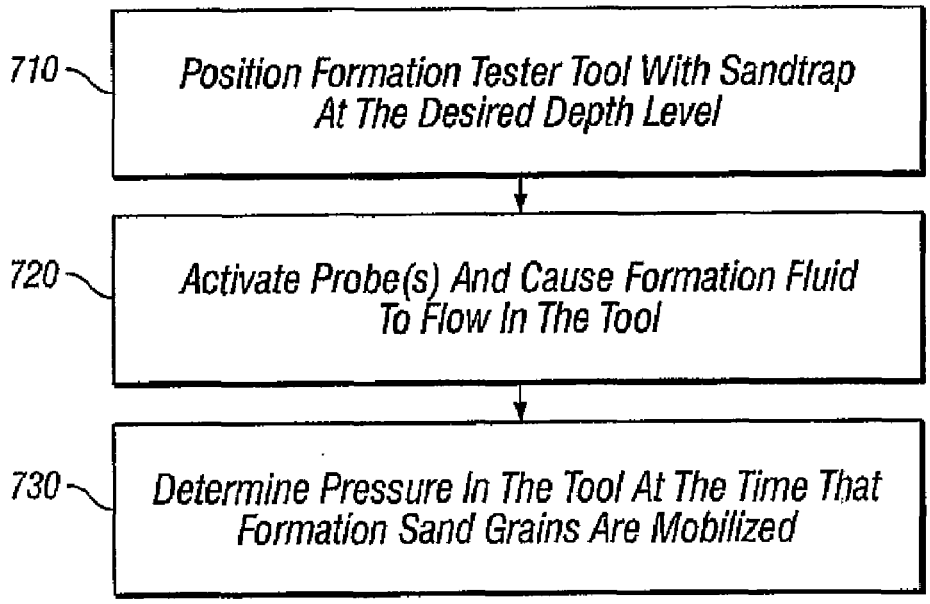
FIG. 7 is a diagram setting forth a sequence of steps in accordance with another embodiment of the invention.

Referring to FIG. 7, there is shown a diagram of steps of a method, in accordance with an embodiment of the invention, for determining the differential pressure at which the well can be expected to start producing sand along with formation fluids. The block 710 represents positioning of a formation tester tool having a sand trap in accordance with the invention, at a desired depth level in the borehole. The block 720 represents activation of probe(s) in the tool, the causing of formation fluid to flow in the tool. The block 730 represents determining of the pressure in the tool at the time that formation sand grains are detected as flowing in the tool.

The invention claimed is:

1. Apparatus for testing formations surrounding an earth borehole, comprising:

a tool movable through the borehole, said tool having a flow line running therethrough;

means, in said tool, for establishing fluid communication between the formations and the flow line in said tool; and a predetermined plurality of sample bottles operatively connected to the flow line, at least one of the plurality of sample bottles being replaced with a sand trap for separating sand from the fluid from the formations traveling in said flow line whereby a sample of sand is collected.

2. Apparatus as defined by claim 1, wherein said sand trap comprises a receptacle containing a screen.

3. Apparatus as defined by claim 2, wherein said screen is operative to cause precipitation of sand in the formation fluid and also to filter sand from the formation fluid.

4. Apparatus as defined by claim 3, wherein said tool includes a pump in said flow line, and wherein said sand trap is located so that sand-containing fluid from the formation reaches said sand trap before reaching said pump.

5. Apparatus as defined by claim 1, wherein said tool includes a pump in said flow line, and wherein said sand trap is located so that sand-containing fluid from the formation reaches said sand trap before reacting said pump.

6. Apparatus as defined by claim 1, further comprising a second sand trap in said tool for trapping sand in the fluid from the formations traveling in said flow line.

7. Apparatus as defined by claim 6 further comprising a valve located in the flow line adjacent each of said sand traps for controlling fluid flow through said sand trap.

8. Apparatus as defined by claim 7 wherein said valve is operative to cause a bypass of said adjacent sand trap by the fluid flowing through the flow line.

9. A method for obtaining a sample of solid materials from formations surrounding an earth borehole, comprising the steps of:

providing a tool that is movable through the borehole, the tool comprising a predetermined plurality of sample bottles, at least one of the plurality of sample bottles being replaced with a sand trap;

setting the tool at a desired depth level;

establishing fluid communication between the formations and the tool;

passing fluid from the formations through the sand trap;

trapping a sample of sand from the fluid passing through the sand trap; and bringing the tool to the surface and recovering the sand from the sand trap.

10. The method as defined by claim 9, further comprising the step of analyzing the sand recovered from the sand trap.

11. The method as defined by claim 10, wherein said sand trap is operative to cause precipitation of sand and also filtering of sand.

12. The method as defined by claim 9, further comprising the step of analyzing said sand to determine the particle size distribution thereof.

13. The method as defined by claim 9, wherein said sand trap is operative to cause precipitation of sand and also filtering of sand.

14. The method as defined by claim 9 further comprising die step of moving the tool to a different depth location and repeating said steps for setting the tool, establishing fluid communication and trapping sand at the different depth location.

15. A method for testing formations surrounding an earth borehole, comprising the steps of:

providing a tool movable through the borehole;

providing a flow line in the tool;

establishing fluid communication between the formations and the flow line of the tool; and providing a predetermined plurality of sample bottles in communication with the flow line of said tool, at least one of the plurality of sample bottles being replaced with a sand trap for trapping sand from the fluid from the formations passing therethrough whereby a sample of sand is collected.

16. The method as defined by claim 15, further comprising bringing the tool to the earth's surface, and recovering the sand from the sand trap.

17. The method as defined by claim 16, further comprising analyzing said sand to determine properties thereof.

18. The method as defined by claim 17, wherein said sand trap is operative to cause precipitation of sand and also filtering of sand.

19. The method as defined by claim 16, further comprising the step of analyzing said recovered sand to determine the particle size distribution thereof.

20. The method as defined by claim 15, wherein said sand trap is operative to cause precipitation of sand and also filtering of sand.

21. The method as defined by claim 15, wherein said step of providing a sand trap comprises providing a plurality of sand traps.

22. The method as defined by claim 15, further comprising determining the pressure in said tool when sand starts to flow with the formation fluid.

* * * * *